United States Patent [19]

Ruff

[11] 4,255,902

[45] Mar. 17, 1981

[54] WEATHER SEALING ASSEMBLY FOR DOORS

[75] Inventor: Robert O. Ruff, Cincinnati, Ohio

[73] Assignee: American Standard Inc., New York, N.Y.

[21] Appl. No.: 2,649

[22] Filed: Jan. 11, 1979

[51] Int. Cl.[3] ..... E06B 7/16

[52] U.S. Cl. ..... 49/488; 49/489

[58] Field of Search ..... 49/481, 482, 488, 489

[56] References Cited

U.S. PATENT DOCUMENTS

| | | | |
|---|---|---|---|
| 3,374,580 | 3/1968 | Ruff | 49/488 X |
| 3,453,780 | 7/1969 | Thompson | 49/488 X |
| 3,854,246 | 12/1974 | McAllister | 49/482 X |

*Primary Examiner*—Kenneth Downey

*Attorney, Agent, or Firm*—James J. Salerno, Jr.; Robert G. Crooks

[57] ABSTRACT

A weather sealing assembly is arranged and constructed to be insertable into a groove or channel formed in the bottom edge surface of a door and which includes means for adjustably positioning the weather sealing assembly mounted in the door and parallel to a sill or threshold whereby cold air and water is prevented from passing between the threshold and the door bottom.

5 Claims, 5 Drawing Figures

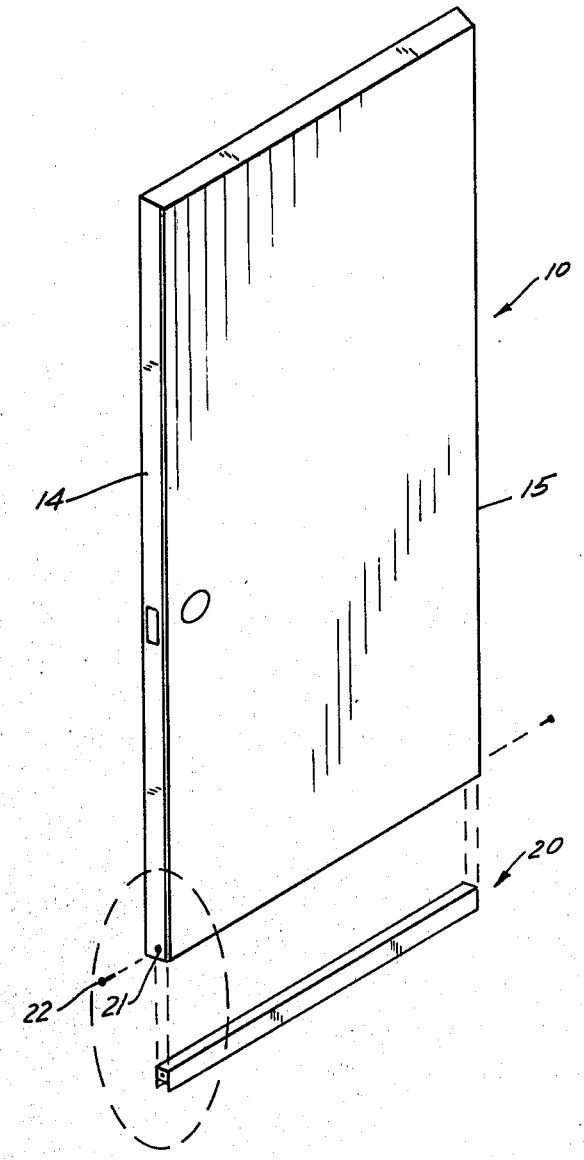
FIG. 1
FIG. 5
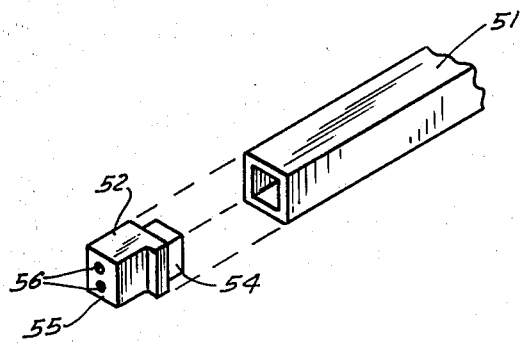

WEATHER SEALING ASSEMBLY FOR DOORS

BACKGROUND OF THE INVENTION

This invention relates to a weather sealing assembly which is adapted to be mounted to a door bottom and which provides means for adjustably positioning the weather sealing assembly parallel to a threshold so as to prevent cold air and water from passing between the door bottom and the threshold.

Weather sealing assemblies have been used for sealing the bottom edge of a door with a threshold to prevent cold air from passing therebetween. For example, U.S. Pat. Nos. 2,917,796, 3,453,780, 3,668,807 and 3,871,133 provide vertically adjustable weather stripping assemblies for doors. U.S. Pat No. 3,453,780 suggests using an adjustable sealing insert having a resilient core so that one or more of the radially extending fingers will contact the threshold. German Pat. No. 2,226,855 describes a threaded plastic nut which can be shifted so that a flexible bulb-like weather strip will contact the threshold.

SUMMARY OF THE INVENTION

An object of the invention is to provide a weather sealing assembly adapted to be adjustably mounted in a groove or channel formed in the bottom surface of a door and having means for positioning said assembly parallel to a threshold for making contact with the outer surface of the threshold to prevent cold air and water from passing between the threshold and the door bottom.

The invention generally contemplates the provision of a weather sealing assembly arranged and constructed to be insertable into a panel or groove formed in the bottom edge surface of a door and adapted to make sealing contact with the threshold when the door is mounted in a door jamb and is in its closed position. The weather sealing assembly includes a generally U-shaped elastomeric member or housing having an outer configuration complementary to the bottom door channel. The elastomeric housing includes a sealing barrier mounted on the upper outer surface and is adapted to make sealing contact between the bottom door channel and the elastomeric housing to prevent cold air and water from passing between the housing and the bottom door channel. A rigid support member is slidably mounted in the U-shaped elastomeric housing and includes latching means for receiving a latching member for adjustably mounting the weather sealing assembly in the bottom door channel. The elastomeric housing includes a pair of resilient and flexible lips which are adapted to make sealing contact with the threshold so as to prevent cold air and water from passing between the threshold and the bottom of the door.

DESCRIPTION OF THE DRAWINGS

The invention is illustrated in the accompanying drawings wherein:

FIG. 1 is an isometric view of a door assembly with the weather sealing assembly exploded therefrom;

FIG. 5 is an alternate embodiment of the support member shown in FIG. 1.

DESCRIPTION OF THE PREFERRED EMBODIMENT

Figure 2:
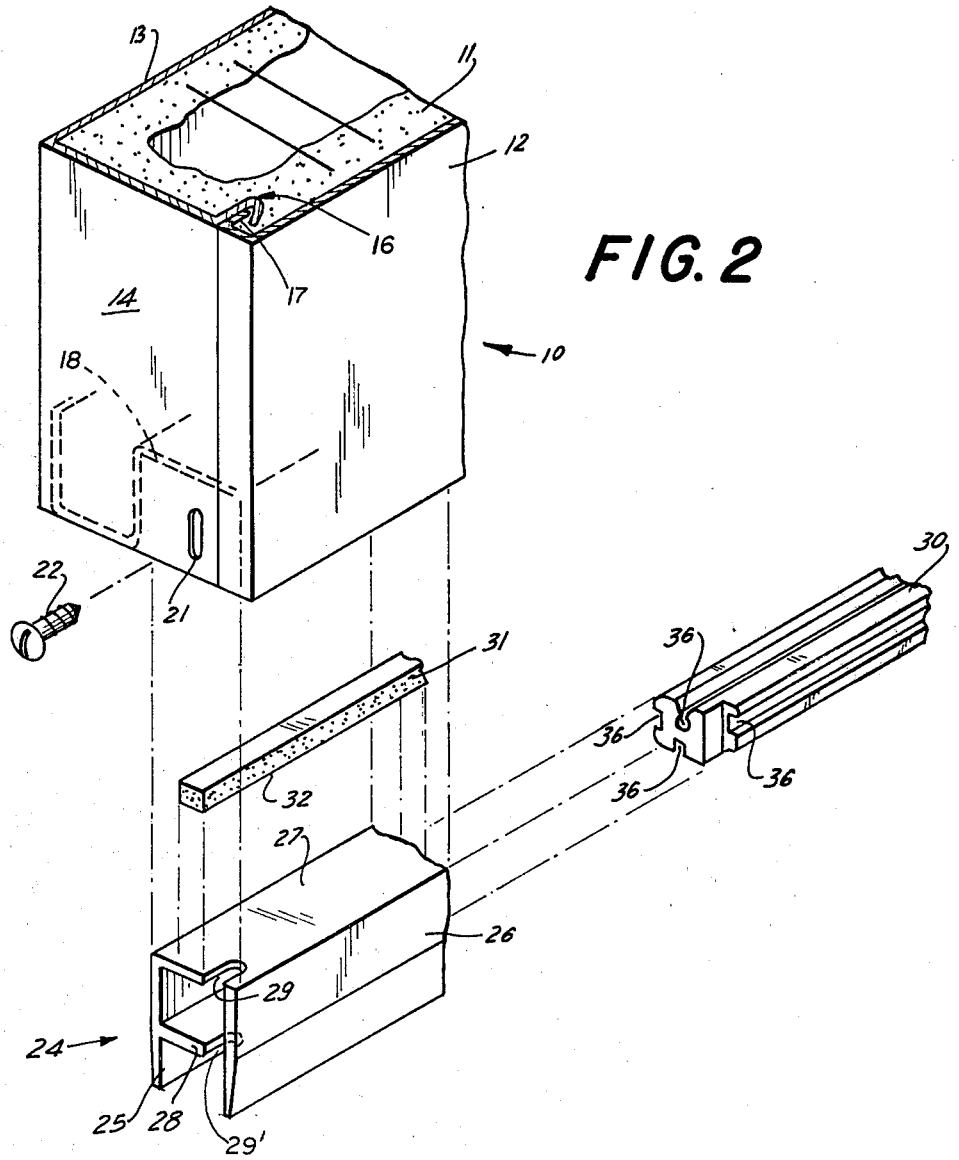
FIG. 2 is an enlarged exploded isometric view, partly in section, of the door and weather sealing assembly shown by the circular area of FIG. 1.
Figure 3:
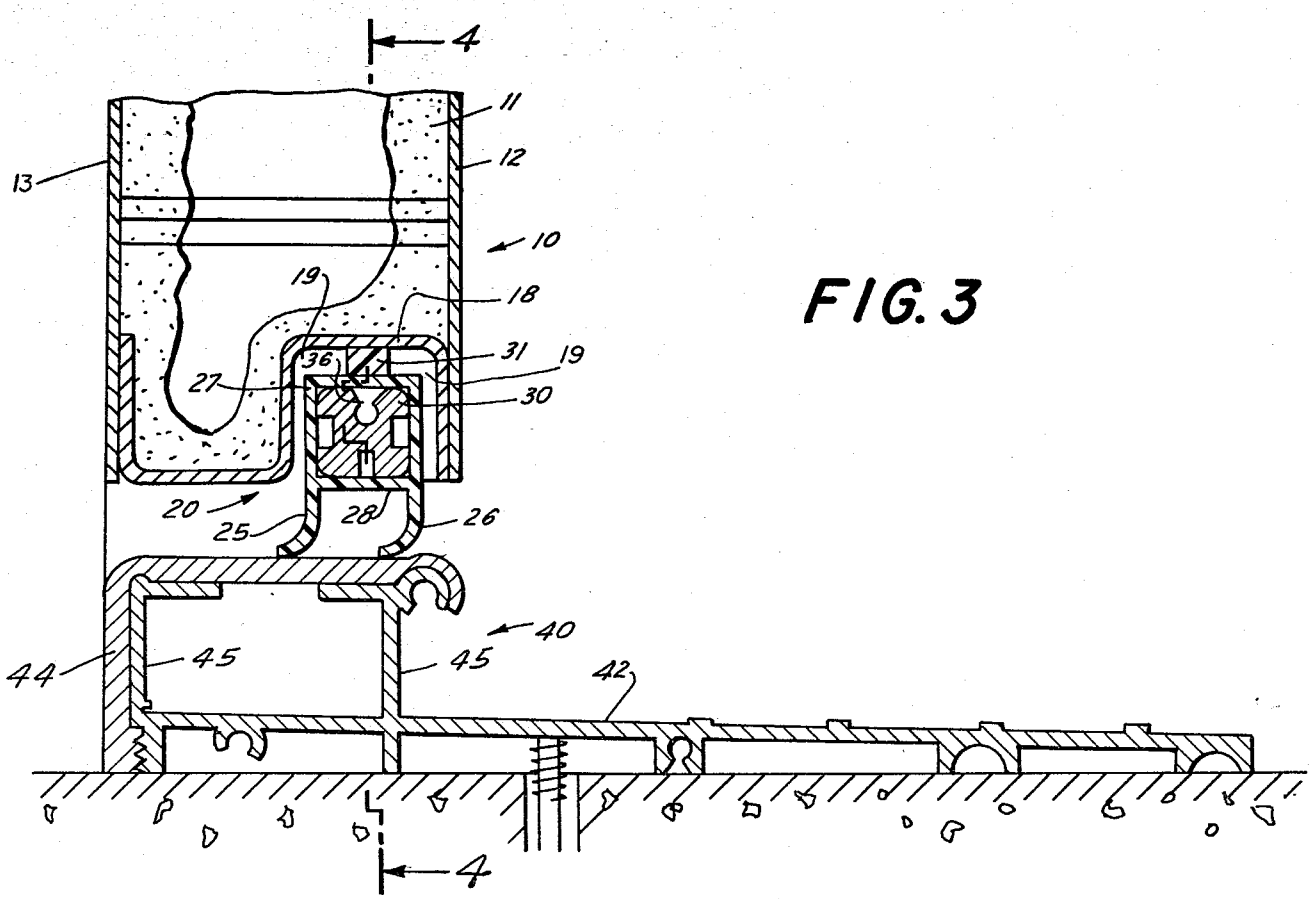
FIG. 3 is an enlarged elevational view in section illustrating the door assembly of FIG. 1 mounted in its closed position on a threshold.
Figure 4:
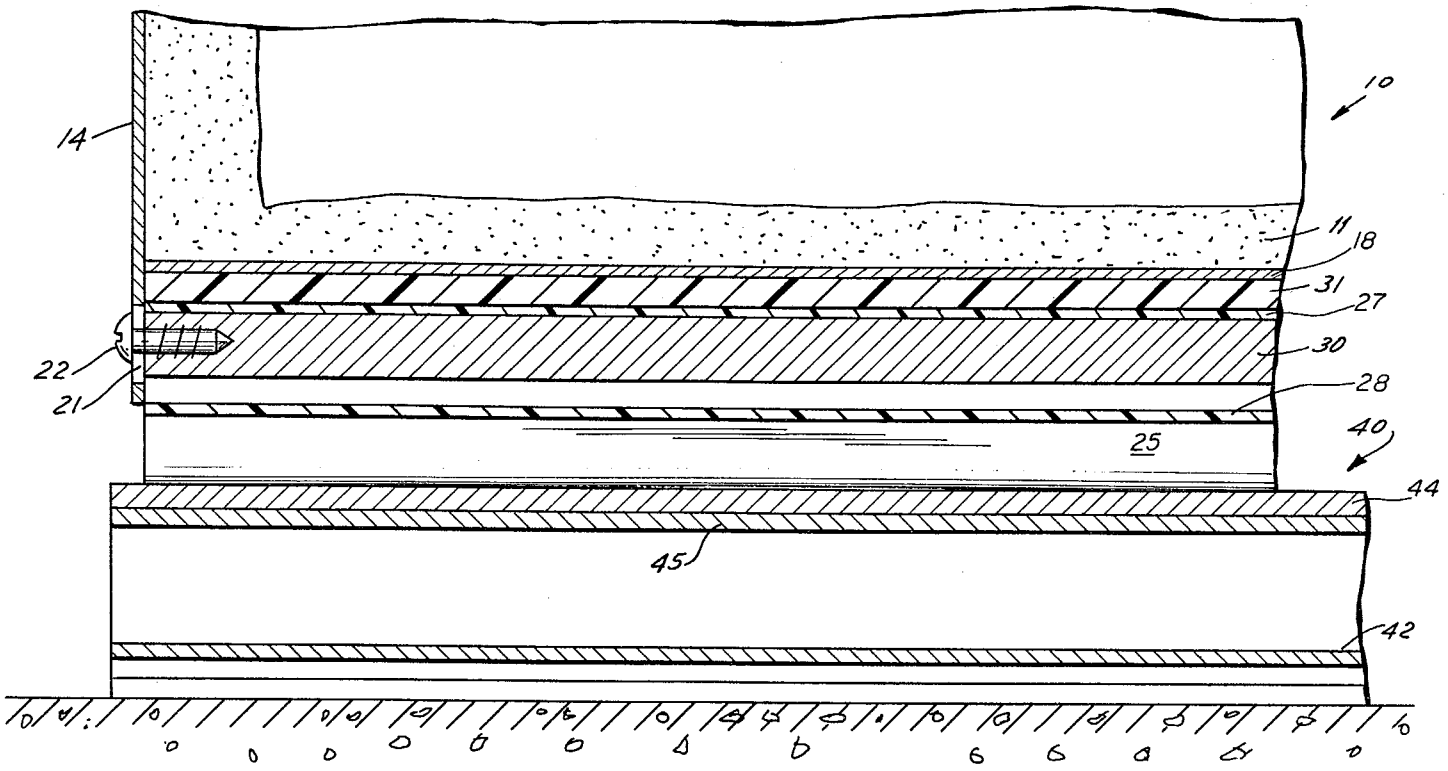
FIG. 4 is a sectional elevational view taken along the lines 4—4 of FIG. 3.

The invention is best illustrated in FIGS. 1 through 4 wherein door 10 has mounted thereon, weather sealing assembly in sealing contact with threshold 40. Door 10, as illustrated in FIG. 3, is of the steel type having a core section 11 sandwiched between two steel sheets which form the opposing inner and outer panels 12 and 13. Right and left stiles 14 and 15 are formed from panel 13 by bending the vertical edges normal to panel 13. A latch 16, made in the shape of a "J", is formed by bending the outer edge sections of vertical stiles 14, 15 as shown in FIG. 2. Panel 12 is likewise bent along each vertical edge section to form a "U" so that the inturned leg 17 fits into latch 16 as shown in FIG. 2. Shown in dotted lines in FIG. 2, the bottom rail of door 10 is suitably mounted between panels 12 and 13 as by spot welding or by adhesive bonding. Bottom rail 18 is shaped to form alternating "U" channels in which inverted "U" section provides channel 19 for housing weather sealing assembly 20 therein. An elongated slot 21 is formed in vertical stiles 14 and 15 adjacent bottom rail 18 so that a screw 22 or other latching means can pass therethrough for adjustably mounting weather sealing assembly 20 therein.

Weather sealing assembly 20 includes a generally U-shaped elastomeric housing 24 having a pair of parallel legs 25, 26 which are integrally formed with a horizontally extending top section 27. A horizontal retaining rail 28 is integrally formed with legs 25, 26 and extends parallel to top section 27 so as to define a generally rectangular area in the upper or enclosed section of elastomeric U-shaped member 24.

Vertically aligned slots 29, 29' are formed at each end of horizontal top section 27 and horizontal rail 28 and lies adjacent the upper end and midsection of leg 26 respectively. Slots 29 and 29' are provided so as to nest between panel 12 and latch 16 so that the outer end sections of parallel legs 25, 26 extend the full width of the door to maintain a maximum sealing area between the door jamb and the door.

A rigid support member 30, generally rectangular in cross section, is made of metal such as extruded aluminum. A plurality of longitudinal extending slots 36, formed along the outer surface of support member 30, is provided with at least one slot being aligned with slotted openings 21 of vertical stiles 14 and 15. Support member 30 is slidably mounted in the rectangular area of the upper section of elastomeric housing 24 so as to provide the necessary mass and rigidity required to maintain the shape of elastomeric housing 24. Aligned slot 36 provides anchor means for screw 22 so that weather sealing assembly 20 can be adjustably mounted in the bottom channel of the door to the desired height relative to threshold 40 to maintain a sealing contact therewith as seen in FIG. 3.

Compressible material 31 is mounted on upper surface of top section 27 to provide a sealing barrier between the bottom channel of the door and housing 24 to prevent cold air and water from passing around weather sealing assembly 20. Compressible foam material 31 is preferably made of a closed cell synthetic foam such as is made from polyurethane, polyethlyene or the like. Compressible material 31 is bonded to the upper surface of top section 27 by applying an adhesive material 32 to the lower face of compressible material 31. When weather sealing assembly 20 is inserted into the channel formed by the bottom rail 18 of door 10, compressible material 31 forms a barrier between the bottom rail 18 and housing 24 so that air and water cannot pass around weather sealing assembly 20.

Elastomeric housing 24 is preferably extruded using either a natural or synthetic elastomeric composition. Upper section of housing 24 is relatively rigid due to horizontal rail 28 while lower section of legs 25, 26 form parallel extending resilient and flexible lips. When door assembly 10 is mounted on a jamb, the lower section of legs 25, 26 are in sealing contact with a threshold 40 as illustrated in FIG. 3. In the preferred form as shown in FIG. 3 elastomeric housing 24 is made of a synthetic elastomer such as ethylene proplyene diene monomer having a Durometer as measured on Shore "A" scale of 70 so that the lower extending section of legs 25, 26 are relatively pliable, flexible to form resilient lips which make a sealing contact with threshold 40.

Threshold 40 includes a body section 42 preferably made of a heavy duty extruded aluminum. A thermalbreak section 44 is mounted on upstanding rails 45 of body 42. Thermalbreak section 44 is preferably made of an extruded plastic material such as vinyl and is shaped in the form of a cap so that the outer surface of the threshold is covered to prevent cold air from directly contacting the aluminum body 42 of threshold 40.

Door assembly 10 when tested for its resistance to wind and water in accordance with ASTM Test No. 331 was found to resist penetration of water and the passage of air. The door assembly, fully assembled as viewed in FIG. 2, was mounted in a doorway fitted with a threshold and was exposed to a wind of 33.8 mph with water being applied to the door at a rate of 5 gal/hr/sq.ft of door for a period of 15 minutes. After completion of the test it was found that no water penetrated the weather sealing assembly mounted in the bottom of the door and that substantially no air passed therethrough.

FIG. 5 illustrates an alternate form 50 of support member 30. Support member 50 is preferably made of metal and as shown in FIG. 5 is a rolled steel tube 51 having a generally rectangular cross section. Support member 50 is shaped and sized to fit into the generally rectangular area of elastomeric housing 24. End plug 52 is preferably made of a moldable plastic material and is formed at one end 54 having a cross sectional area complementary to the cross sectional area of steel tube 51 so that end plug 52 may be mounted on each end of steel tube 51. The other end 55 of end plug 52 is formed having at least one opening 56 to provide means for mounting screws 22 therein to hold weather sealing assembly 20 in any desired position such as is illustrated in FIG. 2.

What is claimed is:

1. In a metal door of the type having a channel formed in the bottom rail and a weather sealing assembly arranged and constructed to be adjustably mounted in said channel to sealingly engage a threshold when said door is mounted in a door jamb in its closed position, said weather sealing assembly comprising:

a generally U-shaped, elastomeric housing having an outer configuration complementary to said door channel and a horizontally extending rail integrally molded with said housing to define a generally rectangular section for retaining a rigid support member therein;

said elastomeric housing adapted t0 be vertically adjustable therein including a pair of spaced, generally parallel, resilient and flexible lips which extend away from the bottom rail of said door and adapted to make sealing engagement with said threshold.

said rigid support member slidably mounted in said generally rectangular section of said elastomeric housing, said rigid support member including a plurality of longitudinally extending slots formed around its outer surfaces and having a generally cross section complementary with said rectangular section of said housing, said at least one of said slots providing such anchor means for receiving said latching member for adjustably mounting said weather sealing assembly in position in the bottom edge surface of the door;

said rigid support member including anchor means for receiving a latch member for mounting said weather sealing assembly in adjusted fixed position;

a compressible foam strip positioned in said channel and mounted between the upper outer surface of said housing and the bottom surface of said channel to prevent cold air and water from passing between the housing and the channel formed in the bottom rail of said door; and said latch member mounted to said anchor means to position said weather sealing assembly in said door channel in fixed adjusted position so that said flexible lips are positioned in sealing engagement with said threshold to prevent air and water from passing therebetween.

2. The weather sealing assembly of claim 1 wherein said elastomeric housing is an extruded synthetic elastomeric material having a Durometer as measured on Shore A scale of about 50–80 whereby said resilient flexible lips are adapted to make sealing contact with said threshold when said door is closed.

3. The weather sealing assembly of claim 2 wherein said elastomeric housing has a Durometer as measured on Shore A scale of about 70.

4. The weather sealing assembly of claim 1 wherein said compressible foam strip is a closed synthetic cellular foam material.

5. In a metal door of the type having a channel formed in the bottom rail and a weather sealing assembly arranged and constructed to be adjustably mounted in said channel to sealingly engage a threshold when said door is mounted in a door jamb in its closed position, said weather sealing assembly comprising:

a generally U-shaped, elastomeric housing having an outer configuration complementary to said door channel and a horizontally extending rail integrally molded with said housing to define a generally rectangular section for retaining a rigid support member therein;

said elastomeric housing adapted to be vertically adjustable therein and including a pair of spaced, generally parallel, resilient and flexible lips which extend away from the bottom rail of said door and adapted to make sealing engagement with said threshold;

said rigid support member slidably mounted in said generally rectangular section of said elastomeric housing;

said rigid support member including a tubular member, an end cap removably mounted on each end of said tubular member for adjustably mounting said weather sealing assembly in position in the bottom edge surface of the door.

a compressible foam strip positioned in said channel and mounted between the upper outer surface of said housing and the bottom surface of said channel to prevent cold air and water from passing between the housing and the channel formed in the bottom rail of said door; and said latch member mounted to said anchor means to position said weather sealing assembly in said door channel in fixed adjusted position so that said flexible lips are positioned in sealing engagement with said threshold to prevent air and water from passing therebetween.

* * * * *